US005080762A

United States Patent [19]

Ochiai et al.

[11] Patent Number: 5,080,762

[45] Date of Patent: Jan. 14, 1992

[54] METHOD FOR SIPHONING LIQUID FROM A PLATED OBJECT DURING PLATING PROCESS

[75] Inventors: Shigeru Ochiai; Masato Wako; Tsugio Endo, all of Saitama, Japan

[73] Assignee: Akebono Brake Industry Co., Ltd., Tokyo, Japan

[21] Appl. No.: 535,150

[22] Filed: Jun. 8, 1990

[30] Foreign Application Priority Data

Jun. 14, 1989 [JP] Japan ..... 1-149731

[51] Int. Cl.[5] ..... C25D 3/00

[52] U.S. Cl. ..... 205/97; 205/151

[58] Field of Search ..... 204/14.1, 55.1, 23, 204/298 R, 40, 300 EC; 137/123, 152; 141/120, 230; 118/400, 500, 423, 501, 506

[56] References Cited

U.S. PATENT DOCUMENTS 2,083,480 6/1937 Spence ..... 137/152

4,935,109 6/1990 Dugan ..... 204/15

*Primary Examiner*—John Niebling

*Assistant Examiner*—Kathryn Gorgos

*Attorney, Agent, or Firm*—Finnegan, Henderson, Farabow, Garrett, and Dunner

[57] ABSTRACT

A siphon and method of immersion and removal of an object to be plated in a liquid for siphoning the liquid from a blind hole in the object. The siphon has a short leg in the blind hole and a long leg exterior of the hole and extending downwardly below the short leg. The siphon may be either non-conductive or conductive. If conductive, it can also serve as an auxiliary electrode in the plating process.

3 Claims, 3 Drawing Sheets

METHOD FOR SIPHONING LIQUID FROM A PLATED OBJECT DURING PLATING PROCESS

BACKGROUND OF THE INVENTION

FIELD OF THE INVENTION

The present invention relates to plating apparatus, and more particularly to a device and method for siphoning liquid from a plated object during the plating process.

In a conventional plating apparatus for plating an object of a metal, a plastic or the like with a film of a metal, the object is sequentially immersed in a plurality of processing vessels while being conveyed by a conveyor, so that the object is subjected to anterior processing, the actual plating, and posterior processing. For example, the plated object is a support member which is for a disc brake, and has a relatively-deep blind hole to receive a guide pin of a caliper member. When the plated object with such a relatively-deep blind hole or chamber is sequentially immersed in a plurality of processing vessels for anterior processing, electroplating, and posterior processing, in such a manner that the open end of the blind hole is located in the top of the object, the processing liquid in the processing vessel enters the blind hole so that liquid mixes with that in the next processing vessel, when the object is immersed into the later vessel. For that reason, the object needs to be turned upside down to drain the processing liquid from the blind hole to prevent the liquid in the hole from mixing with the processing liquid in the next processing vessel when the object is immersed into such vessel. If the mixing were permitted, the processing liquids would prematurely deteriorate. Therefore, the blind hole of the plated object is customarily closed with a rubber plug to prevent such mixing. In that case, however, the processing liquid cannot enter the blind hole to perform anterior processing or the like on the object in the hole in order to plate the interior wall in the hole. This is a problem. Additionally, the rubber plug fitted in the blind hole needs to be removed before the object can be plated. This removal precludes the automation of the plating process, which also presents a problem.

SUMMARY OF THE INVENTION

One object of the present invention is to overcome the above-mentioned problems.

Accordingly, it is the purpose of the present invention to provide a device and method for siphoning liquid from an object which is sequentially immersed in a plurality of processing vessels during plating process. In the embodiment, the siphon is characterized as being substantially J-shaped so that a portion or leg of the siphon, which extends from one end of the siphon to the bend or bight thereof, is shorter than the other portion or leg of the siphon, which extends from the bend or bight to the other end of the siphon; the blind hole which is open at the top portion of the object is fitted with the siphon so that the short leg of the siphon is inserted into the bind hole or chamber, and the long leg of the siphon extends down from the bend or bight thereof. When the plated object, fitted with the siphon, is immersed into each of the processing liquids in the processing vessels for anterior and posterior processing, the processing liquid enters into the long leg of the siphon until the top of the plated object around the open end of the blind hole reaches the surface of the liquid in the vessel.

When the top of the plated object has descended below the surface of the processing liquid in the vessel, the liquid enters the blind hole and closes the open end of the short leg of the siphon so that air is enclosed in the siphon. When the plated object fitted with the siphon, is entirely placed in the processing liquid, the air enclosed in the siphon is moved to the upper portion thereof and stabilized in the bight area thereof. When the plated object fitted with the siphon is lifted out of the processing liquid in each of the processing vessels after the processing of the object therein, the processing liquid remaining in the blind hole of the object is sucked or drawn into the siphon through the lower end of the short leg of the siphon and flows out from the siphon into the processing vessel.

At such time, since the short leg of the siphon is shorter than the other leg, the processing liquid in the longer leg flows out into the processing vessel due to gravity. Although the plated object is sequentially immersed in the processing liquids in the processing vessels, each processing liquid having entered into the blind hole of the object is taken out therefrom through the siphon at the time of the lifting of the object from the vessel. At this time, the object is completely plated with the liquid on the outside surface of the object as well as on the inside surface in the blind hole. More significantly, the liquid is prevented from mixing with the other processing liquid in the next processing vessel which prohibits the contamination of the later processing liquid. Therefore, the purpose of the invention is achieved by allowing each of the processing liquids to be used for a larger number of plated objects.

It is another object of the present invention to provide a siphon for a plated object which is sequentially immersed in a plurality of processing vessels. In another embodiment, the siphon is characterized as being substantially J-shaped so that a portion of the siphon, which extends from one end of the siphon to the bend thereof, is shorter than the other portion of the siphon, which extends from the bend to the other end of the siphon. The plated object having a blind hole exposed at the top portion of the object is fitted with the siphon so that the short leg of the siphon is inserted into the bind hole, the long leg of the siphon extends down from the bend thereof, and the siphon is out of contact with the plated object; and at least the upper parts of the short and long legs of the siphon are made of a material which can undergo electric bipolarity. The siphon not only produces the same effects as the preceding siphon provided in accordance with the present invention, but also acts as a bipolar electrode in a plating liquid of the plating vessel. Since the siphon is made of the material capable of undergoing the electric bipolarity and is placed in the plating liquid of the plating vessel, the siphon acts as an auxiliary anode in the liquid. This allows that portion of the siphon, which is located closest to the plating anode, to act as a cathode due to the electric bipolarity. The portion of the siphon, which is located closest to the plated object which acts as a plating cathode, acts as an anode due to the electric bipolarity. For this reason, a nearly-uniform electrical current flows into the blind hole of the plated object and ensure complete plating therein. The portion of the siphon, which is located closest to the plated object, is placed in the blind hole which makes such part act as the anode. The object can be completely plated in the blind hole without changing the posture of the object in the plating vessel. This allows the plating process of the object to be automated, and the antirust, anticorrosive, and lustrous properties of the inside surfaces of the object to be enhanced.

Additional objects and advantages of the invention will be set forth in part in the description which follows, and in part will be obvious from the description, or may be learned by the practice of the invention. The objects and advantages of the invention may be realized and attained by means of the instrumentalities and combinations particularly pointed out in the appended claims.

The accompanying drawings, which are incorporated in and constitute a part of the specification, illustrate one embodiment of the invention, and together with the description serve to explain the principles of the invention.

DETAILED DESCRIPTION OF EXEMPLARY EMBODIMENTS

Embodiments of the present invention are hereafter described in detail with reference to the drawings attached hereto.

FIGS. 1, 2, 3, 4 and 5 show a plated object 1, a siphon 3 and one of several processing vessels 4. The siphon 3 is one of the embodiments and is for the plated object 1 which is a support member for a disc brake secured to the stationary portion of a vehicle and has a deep blind hole 2. The guide pin of a caliper member which is floatingly supported by the support member is inserted into the blind hole 2 so that the guide pin can be moved inward and outward in the hole. The siphon 3 is generally J-shaped so that a portion 3*a* thereof, which extends from one end of the siphon to the bight thereof, is shorter than another portion 3*b* thereof, which extends from the bight to the other end of the siphon. The siphon 3 is made of material, such as plastic which does not allow the siphon to undergo electric bipolarity.

Figure 1:
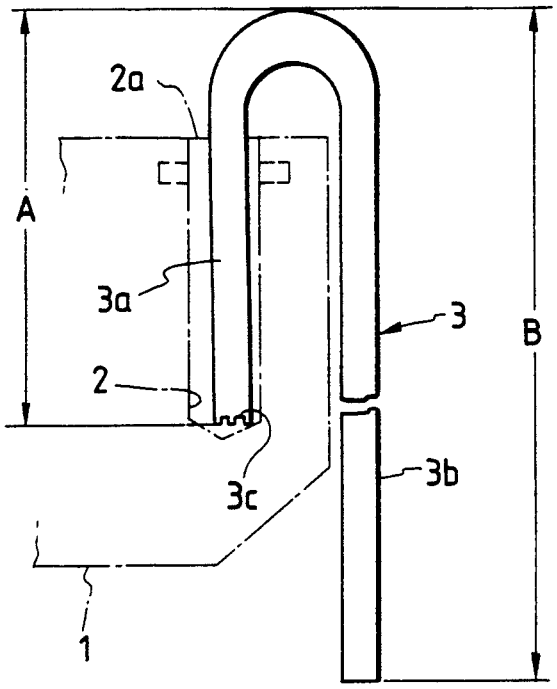
FIG. 1 is a sectional view illustrating a siphon for a object being plated in accordance with one embodiment of the present invention.
Figure 2:
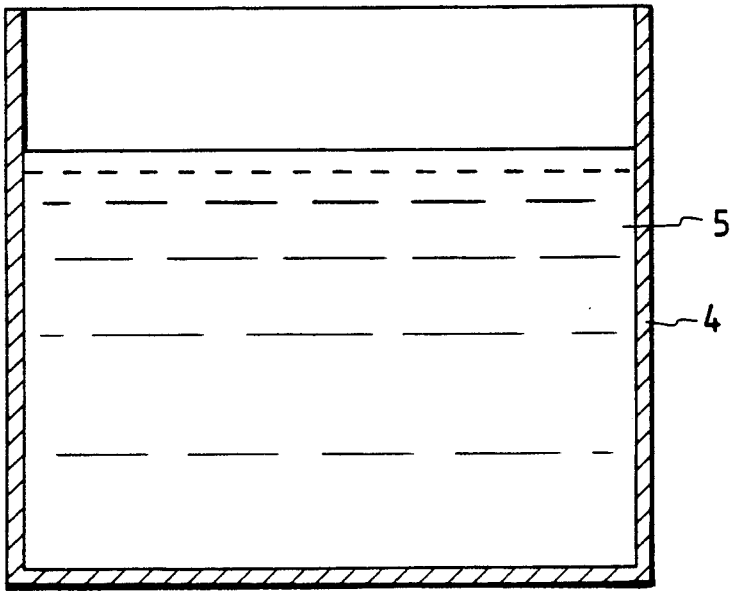
FIG. 2 is a sectional view of a typical processing vessel for the object being plated.
Figure 3:
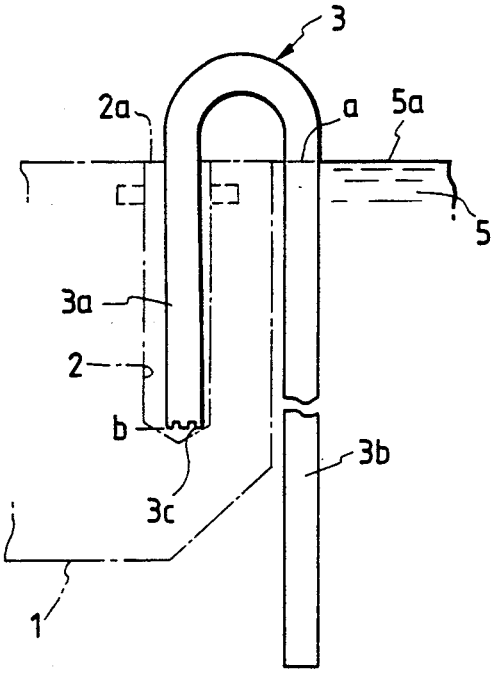
FIG. 3 is a view of the siphon partially immersed in a liquid.
Figure 4:
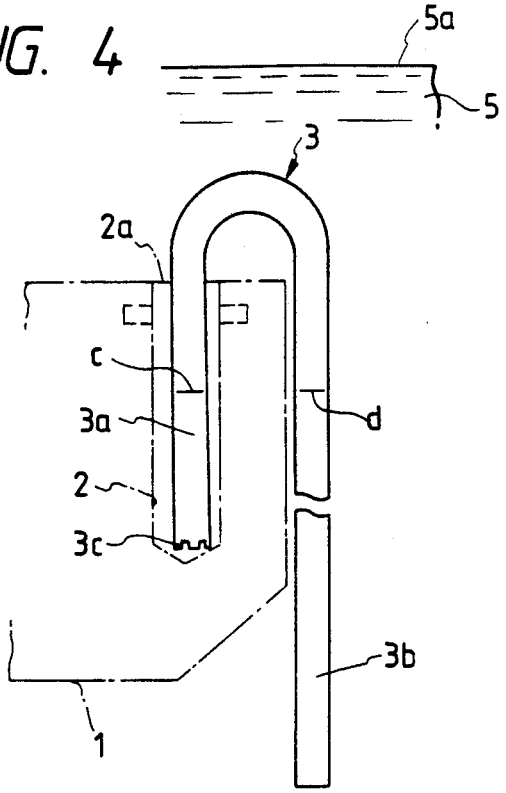
FIG. 4 is a view of the siphon completely immersed in the liquid.
Figure 5:
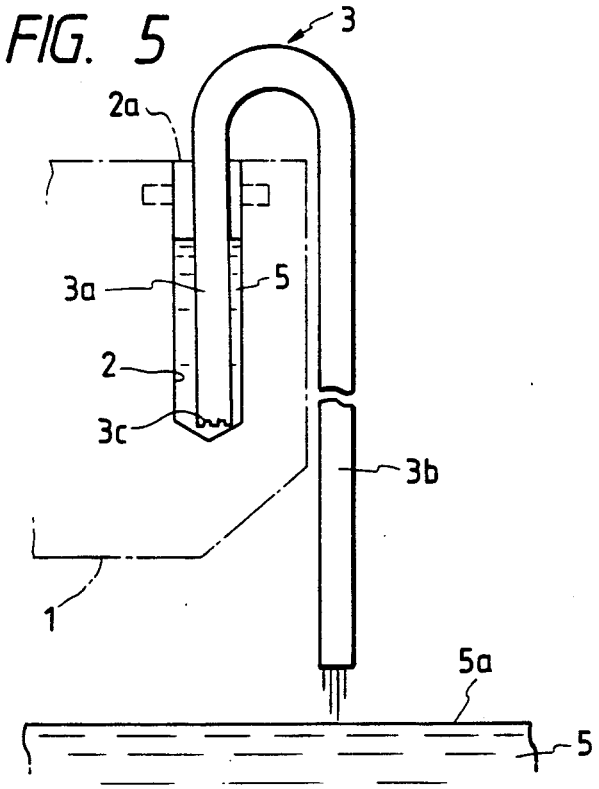
FIG. 5 is a view of the siphon completely withdrawn from processing vessel.

The plated object 1 is fitted with the siphon 3 in such a manner that the open end 2*a* of the blind hole 2 of the object is located in the top thereof, the portion 3*a* of the siphon is inserted down into the hole, and the other portion 3*b* of the siphon extends down from the bight. The plated object 1 thus fitted with the siphon 3 is hooked on a jig and conveyed by a conveyor so that the object is sequentially dipped into the processing vessels 4 each shown in FIG. 2. The jig and the conveyor not shown in the drawings. The processing vessels 4 contain prescribed processing liquids 5 for anterior processing, such as, a series of immersional removals of oil, rinsing, electrolytic removal of oil, rinsing, pickling and rinsing; a prescribed processing liquid 5 for plating; and prescribed processing liquids 5 for posterior processing, such as, a series of rinsing, hot rinsing, and enhancing of anticorrosiveness. As shown in FIG. 3, each of the processing liquids 5 in the processing vessels 4 freely enters into the portion 3*b* of the siphon 3 until the top of the plated object 1 around the open end 2*a* of the blind hole 2 thereof reaches the surface 5*a* of the processing liquid in the process of immersing the object into the liquid. When the top of the plated object 1 around the open end 2*a* of the blind hole 2 has descended below the surface 5*a* of the processing liquid 5, the liquid enters the blind hole and closes the open lower end of the portion 3*a* of the siphon 3 so that air is enclosed between points a and b in the siphon, as shown in FIG. 3. When the plated object 1 and the siphon 3 are immersed deeper in the processing liquid 5, the air in the siphon is moved to points c and d in the upper bend part of the siphon and stabilized in location. To cause this to occur, the open lower end of the portion 3*a* of the siphon 3 must be kept from being closed by the plated object 1 at the lower end of the blind hole 2 thereof. It is preferable that appropriate notches 3*c* are provided in the portion 3*a* of the siphon 3 at the lower end of the portion to make the processing liquid 5 flow into the portion.

When the plated object 1 already processed with each of the processing liquids 5 in the processing vessels 4 is lifted out of the liquid, the processing liquid remaining in the blind hole 2 of the object is removed by the siphon 3 through the lower end of the portion 3*a* and flows out from the siphon into the processing vessel through the other portion 3*b* of the siphon. Since the portion 3*b* of the siphon 3 is longer than the other portion 3*a*, the processing liquid 5 in the portion 3*b* flows out into the processing vessel 4 due to gravity. The air present between the points c and d in the upper bent or bight part of the siphon and the processing liquid present in the portion 3*a* and the blind hole 2 of the object 1 then flow out toward the processing vessel through the siphon. It is preferable that the length B of the portion 3*b* of the siphon 3 is at least 1.5 times as much as that A of the other portion 3*a* to cause the air and the processing liquid to effectively flow out from or through the siphon.

Although the plated object 1 is sequentially immersed in the processing liquids 5 in the processing vessels 4, each processing liquid having entered into the blind hole 2 of the object is removed through the siphon 3 when the object is lifed out of the processing liquid in the processing vessel, as described above. Each processing liquid 5 is prevented from remaining in the blind hole 2 of the plated object 1 after the lifting out of the liquid in the processing vessel 4 and mixing with the other processing liquid 5 in the next processing vessel 4.

Figure 6:
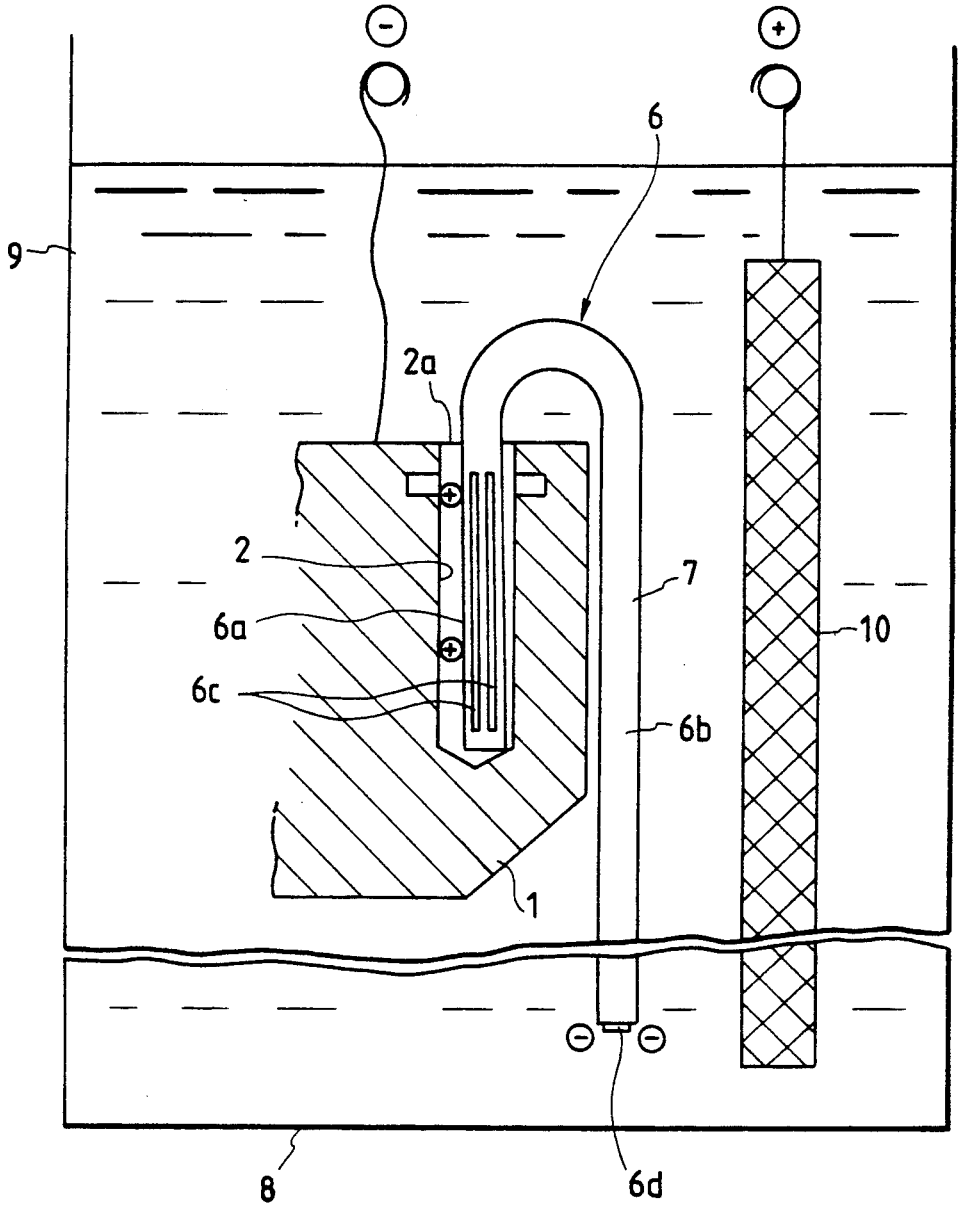
FIG. 6 is a sectional view illustrating a siphon for an object being plated in accordance with another embodiment of the present invention.
Figure 7:
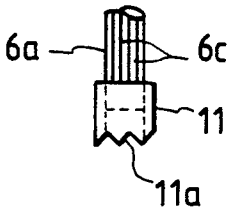
FIG. 7 is a fragmentary view of the siphon shown in FIG. 6 illustrating a modification of the tip of the short tube.

FIGS. 6 and 7 show a plated object 1 and a siphon 6 which is the other of the embodiments and is for the plated object. The siphon 6 is J-shaped so that a portion 6*a*, which extends from one end of the siphon to the bend thereof, is shorter than anther portion 6*b*, which extends from the bend to the other end. The siphon 6 is made of a material which, such as metal, can undergo electric bipolarity. The siphon 6 is coated with a film 7 of an electric insulator except on the lower end of the portion 6*b* of the siphon and the plural slender exposed surface parts 6*c* of the siphon, the length of each of which is nearly equal to the depth of the blind hole 2 of the plated object 1. As a result, the siphon 6 is prevented from coming into contact with the plated object 1. As shown in FIG. 7, a short tube 11 made of an electric insulator and having a plurality of notches 11*a* at the lower end of the tube may be fitted on the portion 6*a* of the siphon 6 at the lower end of the portion. The short tube 11 functions to prevent the lower end of the portion 6*a* of the siphon 6 from coming into electroconductive contact with the plated object 1 when the portion is inserted into the blind hole 2 of the object. The short tube 11 also functions to allow a processing liquid 9 in vessel 8 to flow into the portion 6*a* of the siphon 6 through the lower end of the portion. If the short tube 11 is fitted on the portion 6*a* of the siphon 6 at the lower end of the portion and removed therefrom, each of such plated objects 1 having blind holes 2 different from each other in depth can be fitted with the same siphon so that the siphon is out of contact with the plated object.

When the plated object 1 fitted with the siphon 6 is sequentially immersed in processing liquids in processing vessels, each of the processing liquids enters into the blind hole 2 of the object but is removed from the hole through the siphon when the object is lifted from the processing vessel Each processing liquid is prevented from remaining in the blind hole 2 of the object 1 after the lifting from the processing vessel. If the siphon 6 is placed in a processing liquid 9 containing an anode 10 as shown in FIG. 6, the siphon acts as an auxiliary anode so that the part of the siphon, which is located closest to the anode 10, acts as a cathode due to the electric bipolarity of the siphon, and the other part of the siphon, which is located closest to the plated object 1 which acts as a cathode, acts as an anode due to the electric bipolarity of the siphon. As a result, a nearly-uniform electrical current flows in the blind hole 2 of the plated object 1 as well as outside the object. This ensures that the plating process results in a completely plated object. The portion 6*a* of the siphon 6, which acts as an anode due to the electric bipolarity, is dissolved into the processing liquid 9, and a metal is drawn out on the other portion 6*b* of the siphon, which acts as a cathode due to the electric bipolarity. Therefore, it is preferable that the siphon 6 is made of the metal which is plated on the object 1, or the siphon is made of an electroconductive material which cannot be dissolved into the processing liquid 9 due to the plating. The portion 6*b* of the siphon 6 needs not be entirely made of the material which can undergo the electric bipolarity. However, the upper portions 6*a* and 6*b* of the siphon should be made of the material so that the upper part located closest to the anode 10 acts as a cathode and the other upper part located closest to the plated object 1 acts as an anode.

A support member for a disc brake was actually plated as the plated object 1 fitted with the siphon 6. At that time, a zinc chloride plating vessel was used as the plating vessel 8, and a plating electrical current of 35A per support member was applied thereto for 6 minutes. As a result, the inside surface of the support member in the blind hole thereof was plated with a film of 3μ in mean thickness.

It will be apparent to those skilled in the art that o various modifications and variations can be made in the method and process of the removal of liquid from an object during plating of the present invention, without departing from the spirit and scope of the invention. Thus, it is intended that the present invention cover the modifications and variations of this invention provided they come within the scope of the appended claims and their equivalents.

What is claimed is:

1. A method of immersing and removing an object being plated into and out of a liquid in a container for siphoning the liquid from a chamber in the object, comprising the steps of:

providing a tubular member having a short leg and a long leg joined to a bight portion, said short leg having an open end to permit flow of liquid from the chamber into the tubular member, inserting the short leg into the chamber of the object and positioning the tubular member such that the open end of the long leg extends below the open end of the short leg exterior of the chamber, immersing the open end of the second leg in the liquid while the first leg is inserted in the chamber, continuing the immersion of the object until the first leg and the object including the chamber is immersed in the liquid, and lifting the object until the open end of the long leg is above the liquid level in the container for permitting the liquid to flow from the chamber out of the short leg and the long leg into the container.

2. The method of claim 1 further comprising the steps of conducting an electric current in a path that includes the object being plated, the liquid in the container and the tubular member.

3. The method of claim 1 wherein the step of immersion of the first leg and the object includes entrapping and compressing air in the bight portion of the tubular member.

* * * * *